US008581818B2

(12) United States Patent
Koyama et al.

(10) Patent No.: US 8,581,818 B2
(45) Date of Patent: Nov. 12, 2013

(54) LIQUID CRYSTAL DISPLAY DEVICE AND METHOD FOR DRIVING THE SAME

(75) Inventors: Jun Koyama, Kanagawa (JP); Shunpei Yamazaki, Tokyo (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 333 days.

(21) Appl. No.: 13/072,912

(22) Filed: Mar. 28, 2011

(65) Prior Publication Data

US 2011/0242071 A1 Oct. 6, 2011

(30) Foreign Application Priority Data

Mar. 31, 2010 (JP) ..... 2010-083480

(51) Int. Cl.
*G09G 3/36* (2006.01)

(52) U.S. Cl.
USPC ..... 345/90; 345/87

(58) Field of Classification Search
USPC ..... 345/87–102
See application file for complete search history.

(56) References Cited

U.S. PATENT DOCUMENTS

| | | | |
|---|---|---|---|
| 4,907,862 | A | 3/1990 | Suntola |
| 5,731,856 | A | 3/1998 | Kim et al. |
| 5,744,864 | A | 4/1998 | Cillessen et al. |
| 6,294,274 | B1 | 9/2001 | Kawazoe et al. |
| 6,563,174 | B2 | 5/2003 | Kawasaki et al. |
| 6,597,348 | B1 | 7/2003 | Yamazaki et al. |
| 6,727,522 | B1 | 4/2004 | Kawasaki et al. |
| 7,049,190 | B2 | 5/2006 | Takeda et al. |
| 7,061,014 | B2 | 6/2006 | Hosono et al. |
| 7,064,346 | B2 | 6/2006 | Kawasaki et al. |
| 7,105,868 | B2 | 9/2006 | Nause et al. |
| 7,145,536 | B1 | 12/2006 | Yamazaki et al. |
| 7,161,573 | B1 | 1/2007 | Takatori et al. |
| 7,211,825 | B2 | 5/2007 | Shih et al |
| 7,282,782 | B2 | 10/2007 | Hoffman et al. |
| 7,297,977 | B2 | 11/2007 | Hoffman et al. |
| 7,317,438 | B2 | 1/2008 | Yamazaki et al. |
| 7,323,356 | B2 | 1/2008 | Hosono et al. |

(Continued)

FOREIGN PATENT DOCUMENTS

| | | | |
|---|---|---|---|
| EP | 1 737 044 | A1 | 12/2006 |
| EP | 2 062 668 | A1 | 5/2009 |

(Continued)

OTHER PUBLICATIONS

International Search Report (Application No. PCT/JP2011/055859) Dated Jun. 14, 2011, in English.

(Continued)

*Primary Examiner* — Ricardo L Osorio
(74) *Attorney, Agent, or Firm* — Fish & Richardson P.C.

(57) ABSTRACT

To increase the frequency of input of image signals, a pixel portion of a liquid crystal display device is divided into a plurality of regions, and input of image signals is controlled in each of the plurality of regions. As a result, a plurality of scan lines can be selected at the same time in the liquid crystal display device. That is, in the liquid crystal display device, image signals can be simultaneously supplied to pixels placed in a plurality of rows, among pixels arranged in matrix. Thus, the frequency of input of an image signal to each pixel can be increased without change in response speed of a transistor or the like included in the liquid crystal display device.

20 Claims, 8 Drawing Sheets

(56) References Cited

U.S. PATENT DOCUMENTS

| | | | |
|---|---|---|---|
| 7,385,224 | B2 | 6/2008 | Ishii et al. |
| 7,385,579 | B2 | 6/2008 | Satake |
| 7,402,506 | B2 | 7/2008 | Levy et al. |
| 7,403,177 | B2 | 7/2008 | Tanada et al. |
| 7,411,209 | B2 | 8/2008 | Endo et al. |
| 7,453,065 | B2 | 11/2008 | Saito et al. |
| 7,453,087 | B2 | 11/2008 | Iwasaki |
| 7,462,862 | B2 | 12/2008 | Hoffman et al. |
| 7,468,304 | B2 | 12/2008 | Kaji et al. |
| 7,501,293 | B2 | 3/2009 | Ito et al. |
| 7,652,648 | B2 | 1/2010 | Takatori et al. |
| 7,674,650 | B2 | 3/2010 | Akimoto et al. |
| 7,732,819 | B2 | 6/2010 | Akimoto et al. |
| 2001/0046027 | A1 | 11/2001 | Tai et al. |
| 2002/0056838 | A1 | 5/2002 | Ogawa |
| 2002/0132454 | A1 | 9/2002 | Ohtsu et al. |
| 2003/0189401 | A1 | 10/2003 | Kido et al. |
| 2003/0218222 | A1 | 11/2003 | Wager, III et al. |
| 2004/0038446 | A1 | 2/2004 | Takeda et al. |
| 2004/0127038 | A1 | 7/2004 | Carcia et al. |
| 2005/0017302 | A1 | 1/2005 | Hoffman |
| 2005/0199959 | A1 | 9/2005 | Chiang et al. |
| 2005/0225545 | A1 | 10/2005 | Takatori et al. |
| 2006/0035452 | A1 | 2/2006 | Carcia et al. |
| 2006/0043377 | A1 | 3/2006 | Hoffman et al. |
| 2006/0091793 | A1 | 5/2006 | Baude et al. |
| 2006/0108529 | A1 | 5/2006 | Saito et al. |
| 2006/0108636 | A1 | 5/2006 | Sano et al. |
| 2006/0110867 | A1 | 5/2006 | Yabuta et al. |
| 2006/0113536 | A1 | 6/2006 | Kumomi et al. |
| 2006/0113539 | A1 | 6/2006 | Sano et al. |
| 2006/0113549 | A1 | 6/2006 | Den et al. |
| 2006/0113565 | A1 | 6/2006 | Abe et al. |
| 2006/0169973 | A1 | 8/2006 | Isa et al. |
| 2006/0170111 | A1 | 8/2006 | Isa et al. |
| 2006/0197092 | A1 | 9/2006 | Hoffman et al. |
| 2006/0208977 | A1 | 9/2006 | Kimura |
| 2006/0228974 | A1 | 10/2006 | Thelss et al. |
| 2006/0231882 | A1 | 10/2006 | Kim et al. |
| 2006/0238135 | A1 | 10/2006 | Kimura |
| 2006/0244107 | A1 | 11/2006 | Sugihara et al. |
| 2006/0284171 | A1 | 12/2006 | Levy et al. |
| 2006/0284172 | A1 | 12/2006 | Ishii |
| 2006/0292777 | A1 | 12/2006 | Dunbar |
| 2007/0024187 | A1 | 2/2007 | Shin et al. |
| 2007/0046191 | A1 | 3/2007 | Saito |
| 2007/0052025 | A1 | 3/2007 | Yabuta |
| 2007/0054507 | A1 | 3/2007 | Kaji et al. |
| 2007/0090365 | A1 | 4/2007 | Hayashi et al. |
| 2007/0108446 | A1 | 5/2007 | Akimoto |
| 2007/0152217 | A1 | 7/2007 | Lai et al. |
| 2007/0172591 | A1 | 7/2007 | Seo et al. |
| 2007/0187678 | A1 | 8/2007 | Hirao et al. |
| 2007/0187760 | A1 | 8/2007 | Furuta et al. |
| 2007/0194379 | A1 | 8/2007 | Hosono et al. |
| 2007/0252928 | A1 | 11/2007 | Ito et al. |
| 2007/0272922 | A1 | 11/2007 | Kim et al. |
| 2007/0287296 | A1 | 12/2007 | Chang |
| 2008/0006877 | A1 | 1/2008 | Mardilovich et al. |
| 2008/0038882 | A1 | 2/2008 | Takechi et al. |
| 2008/0038929 | A1 | 2/2008 | Chang |
| 2008/0050595 | A1 | 2/2008 | Nakagawara et al. |
| 2008/0073653 | A1 | 3/2008 | Iwasaki |
| 2008/0083950 | A1 | 4/2008 | Pan et al. |
| 2008/0106191 | A1 | 5/2008 | Kawase |
| 2008/0128689 | A1 | 6/2008 | Lee et al. |
| 2008/0129195 | A1 | 6/2008 | Ishizaki et al. |
| 2008/0166834 | A1 | 7/2008 | Kim et al. |
| 2008/0182358 | A1 | 7/2008 | Cowdery-Corvan et al. |
| 2008/0224133 | A1 | 9/2008 | Park et al. |
| 2008/0254569 | A1 | 10/2008 | Hoffman et al. |
| 2008/0258139 | A1 | 10/2008 | Ito et al. |
| 2008/0258140 | A1 | 10/2008 | Lee et al. |
| 2008/0258141 | A1 | 10/2008 | Park et al. |
| 2008/0258143 | A1 | 10/2008 | Kim et al. |
| 2008/0296568 | A1 | 12/2008 | Ryu et al. |
| 2009/0068773 | A1 | 3/2009 | Lai et al. |
| 2009/0073325 | A1 | 3/2009 | Kuwabara et al. |
| 2009/0114910 | A1 | 5/2009 | Chang |
| 2009/0134399 | A1 | 5/2009 | Sakakura et al. |
| 2009/0152506 | A1 | 6/2009 | Umeda et al. |
| 2009/0152541 | A1 | 6/2009 | Maekawa et al. |
| 2009/0278122 | A1 | 11/2009 | Hosono et al. |
| 2009/0280600 | A1 | 11/2009 | Hosono et al. |
| 2010/0051851 | A1 | 3/2010 | Mitani et al. |
| 2010/0065844 | A1 | 3/2010 | Tokunaga |
| 2010/0092800 | A1 | 4/2010 | Itagaki et al. |
| 2010/0109002 | A1 | 5/2010 | Itagaki et al. |

FOREIGN PATENT DOCUMENTS

| | | | |
|---|---|---|---|
| EP | 2 226 847 | A2 | 9/2010 |
| JP | 60-198861 | A | 10/1985 |
| JP | 61281692 | A | 12/1986 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-239117 | A | 10/1988 |
| JP | 63-265818 | A | 11/1988 |
| JP | 05-119745 | A | 5/1993 |
| JP | 05-251705 | A | 9/1993 |
| JP | 7333574 | A | 12/1995 |
| JP | 8095526 | A | 4/1996 |
| JP | 08-264794 | A | 10/1996 |
| JP | 11-505377 | A | 5/1999 |
| JP | 11258573 | A | 9/1999 |
| JP | 11295694 | A | 10/1999 |
| JP | 2000-044236 | A | 2/2000 |
| JP | 2000-150900 | A | 5/2000 |
| JP | 2001-222260 | A | 8/2001 |
| JP | 2002-062854 | A | 2/2002 |
| JP | 2002-076356 | A | 3/2002 |
| JP | 2002-289859 | A | 10/2002 |
| JP | 2003-086000 | A | 3/2003 |
| JP | 2003-086808 | A | 3/2003 |
| JP | 2004-103957 | A | 4/2004 |
| JP | 2004-273614 | A | 9/2004 |
| JP | 2004-273732 | A | 9/2004 |
| JP | 2005-128153 | A | 5/2005 |
| JP | 2006-220685 | A | 8/2006 |
| JP | 2007-248536 | A | 9/2007 |
| JP | 2008-063651 | A | 3/2008 |
| JP | 2009-009396 | A | 1/2009 |
| JP | 2009-042405 | A | 2/2009 |
| WO | 2004/114391 | A1 | 12/2004 |

OTHER PUBLICATIONS

Written Opinion (Application No. PCT/JP2011/055859) Dated Jun. 14, 2011, in English.

Asakuma, N et al., "Crystallization and Reduction of Sol-Gel-Derived Zinc Oxide Films by Irradiation With Ultraviolet Lamp," Journal of Sol-Gel Science and Technology, 2003, vol. 26, pp. 181-184.

Asaoka, Y et al., "29.1: Polarizer-Free Reflective LCD Combined With Ultra Low-Power Driving Technology," SID Digest '09 : SID International Symposium Digest of Technical Papers, 2009, pp. 395-398.

Chern, H et al., "An Analytical Model for the Above-Threshold Characteristics of Polysilicon Thin-Film Transistors," IEEE Transactions on Electron Devices, Jul. 1, 1995, vol. 42, No. 7, pp. 1240-1246.

Cho, D et al., "21.2: Al and Sn-Doped Zinc Indium Oxide Thin Film Transistors for AMOLED Back-Plane," SID Digest '09 : SID International Symposium Digest of Technical Papers, May 31, 2009, pp. 280-283.

Clark, S et al., "First Principles Methods Using Castep," Zeitschrift fur Kristallographie, 2005, vol. 220, pp. 567-570.

Coates. D et al., "Optical Studies of the Amorphous Liquid-Cholesteric Liquid Crystal Transition: The Blue Phase," Physics Letters, Sep. 10, 1973, vol. 45A, No. 2, pp. 115-116.

(56) References Cited

OTHER PUBLICATIONS

Costello, M et al., "Electron Microscopy of a Cholesteric Liquid Crystal and Its Blue Phase," Phys. Rev. A (Physical Review. A), May 1, 1984, vol. 29, No. 5, pp. 2957-2959.
Dembo, H et al., "RFCPUS on Glass and Plastic Substrates Fabricated by TFT Transfer Technology," IEDM 05: Technical Digest of International Electron Devices Meeting, Dec. 5, 2005, pp. 1067-1069.
Fortunato, E et al., "Wide-Bandgap High-Mobility ZNO Thin-Film Transistors Produced at Room Temperature," Appl. Phys. Lett. (Applied Physics Letters), Sep. 27, 2004, vol. 85, No. 13, pp. 2541-2543.
Fung, T et al., "2-D Numerical Simulation of High Performance Amorphous In—Ga—Zn—-O TFTs for Flat Panel Displays,"AM-FPD '08 Digest of Technical Papers, Jul. 2, 2008, pp. 251-252, The Japan Society of Applied Physics.
Godo, H et al., "P-9: Numerical Analysis on Temperature Dependence of Characteristics of Amorphous In—Ga—Zn-Oxide TFT," SID Digest '09 : SID International Symposium Digest of Technical Papers, May 31, 2009, pp. 1110-1112.
Godo, H et al., "Temperature Dependence of Characteristics and Electronic Structure for Amorphous In—Ga—Zn-Oxide TFT," AM-FPD '09 Digest of Technical Papers, Jul. 1, 2009, pp. 41-44.
Hayashi, R et al., "42.1: Invited Paper: Improved Amorphous IN—Ga—Zn—O TFTS," SID Digest '08 : SID International Symposium Digest of Technical Papers, May 20, 2008, vol. 39, pp. 621-624.
Hirao, T et al.. "Novel Top-Gate Zinc Oxide Thin-Film Transistors (ZNO TFTS) for AMLCDS," Journal of the SID , 2007, vol. 15, No. 1, pp. 17-22.
Hosono, H et al., "Working hypothesis to explore novel wide band gap electrically conducting amorphous oxides and examples," J. Non-Cryst. Solids (Journal of Non-Crystalline Solids), 1996, vol. 198-200, pp. 165-169.
Hosono, H, "68.3: Invited Paper:Transparent Amorphous Oxide Semiconductors for High Performance TFT," SID Digest '07 : SID International Symposium Digest of Technical Papers, 2007, vol. 38, pp. 1830-1833.
Hsieh, H et al., "P-29: Modeling of Amorphous Oxide Semiconductor Thin Film Transistors and Subgap Density of States," SID Digest '08 : SID International Symposium Digest of Technical Papers, 2008, vol. 39, pp. 1277-1280.
Ikeda., T et al.. "Full-Functional System Liquid Crystal Display Using CG-Silicon Technology," SID Digest '04 : SID International Symposium Digest of Technical Papers, 2004, vol. 35, pp. 860-863.
Janotti, A et al., "Native Point Defects in ZnO," Phys. Rev. B (Physical Review. B), 2007, vol. 76, No. 16, pp. 165202-1-165202-22.
Janotti, A et al., "Oxygen Vacancies in ZnO," Appl. Phys. Lett. (Applied Physics Letters), 2005, vol. 87, pp. 122102-1-122102-3.
Jeong, J et al., "3.1: Distinguished Paper: 12.1-Inch WXGA AMOLED Display Driven by Indium-Gallium-Zinc Oxide TFTs Array," SID Digest '08 : SID International Symposium Digest of Technical Papers, May 20, 2008, vol. 39, No. 1, pp. 1-4.
Jin, D et al., "65.2: Distinguished Paper:World-Largest (6.5") Flexible Full Color Top Emission AMOLED Display on Plastic Film and Its Bending Properties," SID Digest '09 : SID International Symposium Digest of Technical Papers, May 31, 2009, pp. 983-985.
Kanno, H et al., "White Stacked Electrophosphorecent Organic Light-Emitting Devices Employing MOO3 as a Charge-Generation Layer," Adv. Mater. (Advanced Materials), 2006, vol. 18, No. 3, pp. 339-342.
Kikuchi, H et al., "39.1: Invited Paper: Optically Isotropic Nano-Structured Liquid Crystal Composites for Display Applications," SID Digest '09 : SID International Symposium Digest of Technical Papers, May 31, 2009, pp. 578-581.
Kikuchi, H et al., "62.2: Invited Paper: Fast Electro-Optical Switching in Polymer-Stabilized Liquid Crystalline Blue Phases for Display Application," SID Digest '07 : SID International Symposium Digest of Technical Papers, 2007, vol. 38, pp. 1737-1740.
Kikuchi, H et al., "Polymer-Stabilized Liquid Crystal Blue Phases," Nature Materials, Sep. 1, 2002, vol. 1, pp. 64-68.
Kim, S et al., "High-Performance oxide thin film transistors passivated by various gas plasmas," The Electrochemical Society, 214th ECS Meeting, 2008, No. 2317, 1 page.
Kimizuka, N et al., "Spinel,YBFE2O4, and YB2FE3O7 Types of Structures for Compounds in the IN2O3 and SC2O3-A2O3-BO Systems [A; Fe, Ga, Or Al; B: Mg, Mn, Fe, Ni, Cu,or Zn] at Temperatures Over 1000° C.," Journal of Solid State Chemistry, 1985, vol. 60, p. 382-384.
Kimizuka, N et al., "Syntheses and Single-Crystal Data of Homologous Compounds, In2O3(ZnO)m (m = 3, 4, and 5), InGaO3(ZnO)3, and Ga2O3(ZnO)m (m = 7, 8, 9, and 16) in the In2O3—ZnGa2O4—ZnO System," Journal of Solid State Chemistry, Apr. 1, 1995, vol. 116, No. 1, pp. 170-178.
Kitzerow, H et al., "Observation of Blue Phases in Chiral Networks," Liquid Crystals, 1993, vol. 14, No. 3, pp. 911-916.
Kurokawa, Y et al., "UHF RFCPUS on Flexible and Glass Substrates for Secure RFID Systems," Journal of Solid-State Circuits , 2008, vol. 43, No. 1, pp. 292-299.
Lany, S et al., "Dopability, Intrinsic Conductivity, and Nonstoichiometry of Transparent Conducting Oxides," Phys. Rev. Lett. (Physical Review Letters), Jan. 26, 2007, vol. 98, pp. 045501-1-045501-4.
Lee, H et al., "Current Status of, Challenges to, and Perspective View of AM-OLED," IDW '06 : Proceedings of the 13th International Display Workshops, Dec. 7, 2006, pp. 663-666.
Lee, J et al., "World's Largest (15-Inch) XGA AMLCD Panel Using IGZO Oxide TFT," SID Digest '08 : SID International Symposium Digest of Technical Papers, May 20, 2008, vol. 39, pp. 625-628.
Lee, M et al., "15.4: Excellent Performance of Indium-Oxide-Based Thin-Film Transistors by DC Sputtering," SID Digest '09 : SID International Symposium Digest of Technical Papers, May 31, 2009, pp. 191-193.
Li, C et al. "Modulated Structures of Homologous Compounds InMO3(ZnO)m (M=In,Ga; m=Integer) Described by Four-Dimensional Superspace Group," Journal of Solid State Chemistry, 1998, vol. 139, pp. 347-355.
Masuda, S et al., "Transparent thin film transistors using ZnO as an active channel layer and their electrical properties," J. Appl. Phys. (Journal of Applied Physics), Feb. 1, 2003, vol. 93, No. 3, pp. 1624-1630.
Meiboom, S et al., "Theory of the Blue Phase of Cholesteric Liquid Crystals," Phys. Rev. Lett. (Physical Review Letters), May 4, 1981, vol. 46, No. 18, pp. 1216-1219.
Miyasaka, M, "Suftla Flexible Microelectronics on Their Way to Business," SID Digest '07 : SID International Symposium Digest of Technical Papers, 2007, vol. 38, pp. 1673-1676.
Mo, Y et al., "Amorphous Oxide TFT Backplanes for Large Size AMOLED Displays," IDW '08 : Proceedings of the 6th International Display Workshops, Dec. 3, 2008, pp. 581-584.
Nakamura, "Synthesis of Homologous Compound with New Long-Period Structure," NIRIM Newsletter, Mar. 1995, vol. 150, pp. 1-4 with English translation.
Nakamura, M et al., "The phase relations in the In2O3—Ga2ZnO4—ZnO system at 1350° C.," Journal of Solid State Chemistry, Aug. 1, 1991, vol. 93, No. 2, pp. 298-315.
Nomura, K et al., "Thin-Film Transistor Fabricated in Single-Crystalline Transparent Oxide Semiconductor," Science, May 23, 2003, vol. 300, No. 5623, pp. 1269-1272.
Nomura, K et al., "Amorphous Oxide Semiconductors for High-Performance Flexible Thin-Film Transistors," Jpn. J. Appl. Phys. (Japanese Journal of Applied Physics) , 2006, vol. 45, No. 5B, pp. 4303-4308.
Nomura, K et al., "Room-Temperature Fabrication of Transparent Flexible Thin-Film Transistors Using Amorphous Oxide Semiconductors," Nature, Nov. 25, 2004, vol. 432, pp. 488-492.
Nomura, K et al., "Carrier transport in transparent oxide semiconductor with intrinsic structural randomness probed using single-crystalline InGaO3(ZnO)5 films," Appl. Phys. Lett. (Applied Physics Letters) , Sep. 13, 2004, vol. 85, No. 11, pp. 1993-1995.

(56) References Cited

OTHER PUBLICATIONS

Nowatari, H et al., "60.2: Intermediate Connector With Suppressed Voltage Loss for White Tandem OLEDS," SID Digest '09 : SID International Symposium Digest of Technical Papers, May 31, 2009, vol. 40, pp. 899-902.
Oba, F et al., "Defect energetics in ZnO: A hybrid Hartree-Fock density functional study," Phys. Rev. B (Physical Review. B), 2008, vol. 77, pp. 245202-1-245202-6.
Oh, M et al., "Improving the Gate Stability of ZnO Thin-Film Transistors With Aluminum Oxide Dielectric Layers," J. Electrochem. Soc. (Journal of the Electrochemical Society), 2008, vol. 155, No. 12, pp. H1009-H1014.
Ohara, H et al., "21.3: 4.0 In. QVGA AMOLED Display Using In—Ga—Zn-Oxide TFTS With a Novel Passivation Layer," SID Digest '09 : SID International Symposium Digest of Technical Papers, May 31, 2009, pp. 284-287.
Ohara, H et al., "Amorphous In—Ga—Zn-Oxide TFTs with Suppressed Variation for 4.0 inch QVGA AMOLED Display," AM-FPD '09 Digest of Technical Papers, Jul. 1, 2009, pp. 227-230, The Japan Society of Applied Physics.
Orita, M et al., "Amorphous transparent conductive oxide InGaO3(ZnO)m (m<4):a Zn4s conductor," Philosophical Magazine, 2001, vol. 81, No. 5, pp. 501-515.
Orita, M et al., "Mechanism of Electrical Conductivity of Transparent InGaZnO4," Phys. Rev. B (Physical Review. B), Jan. 15, 2000, vol. 61, No. 3, pp. 1811-1816.
Osada, T et al.. "15.2: Development of Driver-Integrated Panel using Amorphous In—Ga—Zn-Oxide TFT," SID Digest '09 : SID International Symposium Digest of Technical Papers, May 31, 2009, pp. 184-187.
Osada, T et al., "Development of Driver-Integrated Panel Using Amorphous In—Ga—Zn-Oxide TFT," AM-FPD '09 Digest of Technical Papers, Jul. 1, 2009, pp. 33-36.
Park, J et al., "Dry etching of ZnO films and plasma-induced damage to optical properties," J. Vac. Sci. Technol. B (Journal of Vacuum Science & Technology B), Mar. 1, 2003, vol. 21, No. 2, pp. 800-803.
Park. J et al., "Improvements in the Device Characteristics of Amorphous Indium Gallium Zinc Oxide Thin-Film Transistors by Ar Plasma Treatment," Appl. Phys. Lett. (Applied Physics Letters), Jun. 26, 2007, vol. 90, No. 26, pp. 262106-1-262106-3.
Park, J et al., "Electronic Transport Properties of Amorphous Indium-Gallium-Zinc Oxide Semiconductor Upon Exposure to Water," Appl. Phys. Lett. (Applied Physics Letters), 2008, vol. 92, pp. 072104-1-072104-3.
Park, J et al., "High performance amorphous oxide thin film transistors with self-aligned top-gate structure," IEDM 09: Technical Digest of International Electron Devices Meeting, Dec. 7, 2009, pp. 191-194.
Park, Sang-Hee et al., "42.3: Transparent ZnO Thin Film Transistor for the Application of High Aperture Ratio Bottom Emission AM-OLED Display," SID Digest '08 : SID International Symposium Digest of Technical Papers, May 20, 2008, vol. 39, pp. 629-632.
Park, J et al., "Amorphous Indium-Gallium-Zinc Oxide TFTS and Their Application for Large Size AMOLED." AM-FPD '08 Digest of Technical Papers, Jul. 2, 2008, pp. 275-278.
Park, S et al., "Challenge to Future Displays: Transparent AM-OLED Driven by Peald Grown ZNO TFT," IMID '07 Digest, 2007, pp. 1249-1252.
Prins, M et al., "A Ferroelectric Transparent Thin-Film Transistor," Appl. Phys. Lett. (Applied Physics Letters), Jun. 17, 1996, vol. 68, No. 25, pp. 3650-3652.
Sakata, J et al., "Development of 4.0-In. AMOLED Display With Driver Circuit Using Amorphous In—Ga—Zn-Oxide TFTS," IDW '09 : Proceedings of the 16th International Display Workshops, 2009, pp. 689-692.
Son, K et al., "42.4L: Late-News Paper: 4 Inch QVGA AMOLED Driven by the Threshold Voltage Controlled Amorphous GIZO (Ga2O3—In2O3—ZnO) TFT," SID Digest '08 : SID International Symposium Digest of Technical Papers, May 20, 2008, vol. 39, pp. 633-636.
Takahashi, M et al., "Theoretical Analysis of IGZO Transparent Amorphous Oxide Semiconductor," IDW '08 : Proceedings of the 15th International Display Workshops, Dec. 3, 2008, pp. 1637-1640.
Tsuda, K et al., "Ultra Low Power Consumption Technologies for Mobile TFT-LCDs," IDW '02 : Proceedings of the 9th International Display Workshops, Dec. 4, 2002, pp. 295-298.
Ueno, K et al., "Field-Effect Transistor on SrTiO3 With Sputtered Al2O3 Gate Insulator," Appl. Phys. Lett. (Applied Physics Letters), Sep. 1, 2003, vol. 82, No. 9, pp. 1755-1757.
Van De Walle, C, "Hydrogen as a Cause of Doping in Zinc Oxide," Phys. Rev. Lett. (Physical Review Letters), Jul. 31, 2000, vol. 85, No. 5, pp. 1012-1015.

LIQUID CRYSTAL DISPLAY DEVICE AND METHOD FOR DRIVING THE SAME

TECHNICAL FIELD

The present invention relates to a liquid crystal display device and a method for driving the liquid crystal display device. In particular, the present invention relates to a liquid crystal display device in which images are displayed by a field sequential method, and a method for driving the liquid crystal display device.

BACKGROUND ART

A color filter method and a field sequential method are known as display methods for liquid crystal display devices. In a liquid crystal display device in which images are displayed by a color filter method, a plurality of subpixels each having a color filter that only transmits light with a wavelength of a given color (e.g., red (R), green (G), or blue (B)) are provided in each pixel. A desired color is produced in such a manner that transmission of white light is controlled in each subpixel and a plurality of colors are mixed in each pixel. On the other hand, in a liquid crystal display device in which images are displayed by a field sequential method, a plurality of light sources that emit lights of different colors (e.g., red (R), green (G), and blue (B)) are provided. A desired color is produced in such a manner that the plurality of light sources sequentially emit light and transmission of light of each color is controlled in each pixel. In other words, a desired color is produced by dividing the area of one pixel by lights of given colors in a color filter method, whereas a desired color is produced by dividing a display period by lights of given colors in a field sequential method.

The liquid crystal display device in which images are displayed by a field sequential method has the following advantages over the liquid crystal display device in which images are displayed by a color filter method. First, in the liquid crystal display device employing a field sequential method, it is not necessary to provide subpixels in a pixel. Thus, the aperture ratio or the number of pixels can be increased. In addition, in the liquid crystal display device employing a field sequential method, it is not necessary to provide a color filter. That is, loss of light due to light absorption in the color filter does not occur. For that reason, the transmittance can be increased and power consumption can be reduced.

Patent Document 1 discloses a liquid crystal display device in which images are displayed by a field sequential method. Specifically, Patent Document 1 discloses a liquid crystal display device in which pixels each include a transistor for controlling input of an image signal, a signal storage capacitor for holding the image signal, and a transistor for controlling transfer of electric charge from the signal storage capacitor to a display pixel capacitor. In the liquid crystal display device having this structure, writing of an image signal to the signal storage capacitor and display corresponding to electric charge held at the display pixel capacitor can be performed at the same time.

Reference

Patent Document 1: Japanese Published Patent Application No. 2009-042405

DISCLOSURE OF INVENTION

In a liquid crystal display device in which images are displayed by a field sequential method, the frequency of input of an image signal to each pixel needs to be increased. For example, in the case where images are displayed by a field sequential method in a liquid crystal display device including three kinds of light sources, each of which emits one of red (R) light, green (G) light, and blue (B) light, the frequency of input of an image signal to each pixel needs to be at least three times as high as that of a liquid crystal display device in which images are displayed by a color filter method. Specifically, in the case where the frame frequency is 60 Hz, an image signal needs to be input to each pixel 60 times per second in the liquid crystal display device in which images are displayed by a color filter method; whereas an image signal needs to be input to each pixel 180 times per second in the case where images are displayed by a field sequential method in the liquid crystal display device including three kinds of light sources.

Note that high-speed response of an element included in each pixel is required, accompanied by the increase in the input frequency of image signals. Specifically, the increase in mobility of a transistor provided in each pixel is required, for example. However, it is not easy to improve characteristics of the transistor or the like.

In view of the above, an object of one embodiment of the present invention is to increase the frequency of input of image signals in terms of design.

The above-described object can be achieved in the following manner: a pixel portion of a liquid crystal display device is divided into a plurality of regions, and input of an image signal is controlled in each of the plurality of regions.

According to one embodiment of the present invention, a liquid crystal display device includes a first signal line supplied with a first image signal in a horizontal scan period, a second signal line supplied with a second image signal in the horizontal scan period, a first scan line and a second scan line supplied with a selection signal in the horizontal scan period, a first pixel electrically connected to the first signal line and the first scan line, and a second pixel electrically connected to the second signal line and the second scan line.

In the liquid crystal display device according to one embodiment of the present invention, a plurality of scan lines can be selected at the same time. That is, in the liquid crystal display device according to one embodiment of the present invention, image signals can be simultaneously supplied to pixels placed in a plurality of rows, among pixels arranged in matrix. Thus, the frequency of input of an image signal to each pixel can be increased without change in response speed of a transistor or the like included in the liquid crystal display device.

BEST MODE FOR CARRYING OUT THE INVENTION

Embodiments of the present invention will be described below in detail with reference to the accompanying drawings. Note that the present invention is not limited to the description below, and it is easily understood by those skilled in the art that a variety of changes and modifications can be made without departing from the spirit and scope of the present invention. Therefore, the present invention should not be construed as being limited to the description of the embodiments.

First, an example of a liquid crystal display device in which images are displayed by a field sequential method will be described with reference to FIGS. 1A to 1D, FIGS. 2A to 2C, FIG. 3, and FIGS. 4A and 4B.

(Structural Example of Liquid Crystal Display Device)

Figure 1A:
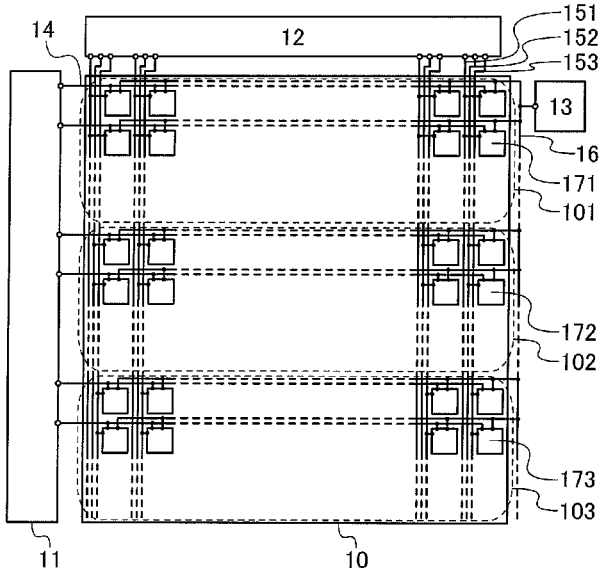
FIG. 1A illustrates a structural example of a liquid crystal display device, and FIGS. 1B to 1D each illustrate a configuration example of a pixel.

FIG. 1A illustrates a structural example of a liquid crystal display device. The liquid crystal display device in FIG. 1A includes a pixel portion 10; a scan line driver circuit 11; a signal line driver circuit 12; a transfer signal line driver circuit 13; 3n scan lines 14 (n is a natural number of 2 or more) arranged parallel or approximately parallel to each other; m signal lines 151, m signal lines 152, and m signal lines 153 (m is a natural number of 2 or more) arranged parallel or approximately parallel to each other; and a transfer signal line 16 having 3n branch lines arranged parallel or approximately parallel to the scan lines 14. The potentials of the scan lines 14 are controlled by the scan line driver circuit 11. The potentials of the signal lines 151, 152, and 153 are controlled by the signal line driver circuit 12.

The pixel portion 10 is divided into three regions (regions 101 to 103), and each region includes a plurality of pixels arranged in matrix (of n rows and m columns). Each of the scan lines 14 is electrically connected to m pixels arranged in a given row, among the plurality of pixels arranged in matrix (of 3n rows and m columns) in the pixel portion 10. Each of the signal lines 151 is electrically connected to n pixels arranged in a given column, among the plurality of pixels arranged in matrix (of n rows and m columns) in the region 101. Each of the signal lines 152 is electrically connected to n pixels arranged in a given column, among the plurality of pixels arranged in matrix (of n rows and m columns) in the region 102. Each of the signal lines 153 is electrically connected to n pixels arranged in a given column, among the plurality of pixels arranged in matrix (of n rows and m columns) in the region 103. The transfer signal line 16 is electrically connected to all the plurality of pixels arranged in matrix (of 3n rows and m columns) in the pixel portion 10.

To the scan line driver circuit 11, start signals (GSP1 to GSP3) for the scan line driver circuit, a clock signal (GCK) for the scan line driver circuit, and drive power supplies such as high power supply potentials (VDD1 and VDD2) and a low power supply potential (VSS) are input from the outside. To the signal line driver circuit 12, signals such as a start signal (SSP) for the signal line driver circuit, a clock signal (SCK) for the signal line driver circuit, and image signals (DATA1 to DATA3) and drive power supplies such as a high power supply potential and a low power supply potential are input from the outside.

Figure 1B:
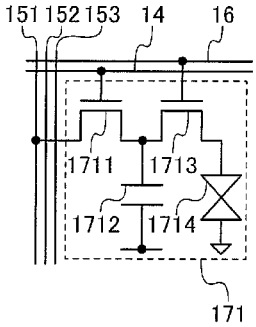
Figure 1C:
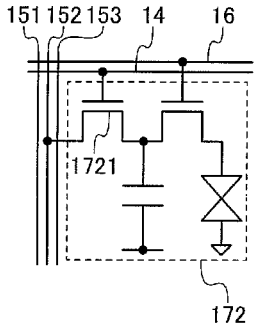
Figure 1D:
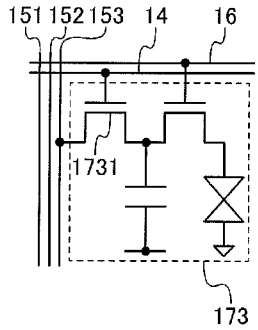

FIGS. 1B to 1D each illustrate an example of a circuit configuration of a pixel. Specifically, FIG. 1B illustrates an example of a circuit configuration of a pixel 171 placed in the region 101. FIG. 1C illustrates an example of a circuit configuration of a pixel 172 placed in the region 102. FIG. 1D illustrates an example of a circuit configuration of a pixel 173 placed in the region 103. The pixel 171 in FIG. 1B includes a transistor 1711, a capacitor 1712, a transistor 1713, and a liquid crystal element 1714. A gate of the transistor 1711 is electrically connected to the scan line 14. One of a source and a drain of the transistor 1711 is electrically connected to the signal line 151. One of electrodes of the capacitor 1712 is electrically connected to the other of the source and the drain of the transistor 1711. The other of the electrodes of the capacitor 1712 is electrically connected to a wiring that supplies a capacitor potential. A gate of the transistor 1713 is electrically connected to the transfer signal line 16. One of a source and a drain of the transistor 1713 is electrically connected to the other of the source and the drain of the transistor 1711 and one of the electrodes of the capacitor 1712. One of electrodes (a pixel electrode) of the liquid crystal element 1714 is electrically connected to the other of the source and the drain of the transistor 1713. The other of the electrodes (a counter electrode) of the liquid crystal element 1714 is electrically connected to a wiring that supplies a counter potential.

The pixel 172 in FIG. 1C and the pixel 173 in FIG. 1D have the same circuit configuration as the pixel 171 in FIG. 1B. Note that the pixel 172 in FIG. 1C differs from the pixel 171 in FIG. 1B in that one of a source and a drain of a transistor 1721 is electrically connected to the signal line 152 instead of the signal line 151. The pixel 173 in FIG. 1D differs from the pixel 171 in FIG. 1B in that one of a source and a drain of a transistor 1731 is electrically connected to the signal line 153 instead of the signal line 151.

Note that the liquid crystal element illustrated in FIGS. 1B to 1D is preferably formed using a liquid crystal material exhibiting a blue phase. Here, a liquid crystal material refers to a mixture that includes liquid crystals and is used for a liquid crystal layer. By using a liquid crystal material exhibiting a blue phase, the rise time and fall time of the liquid crystal element can be 200 microseconds or less.

(Structural Example of Scan Line Driver Circuit 11)

Figure 2A:
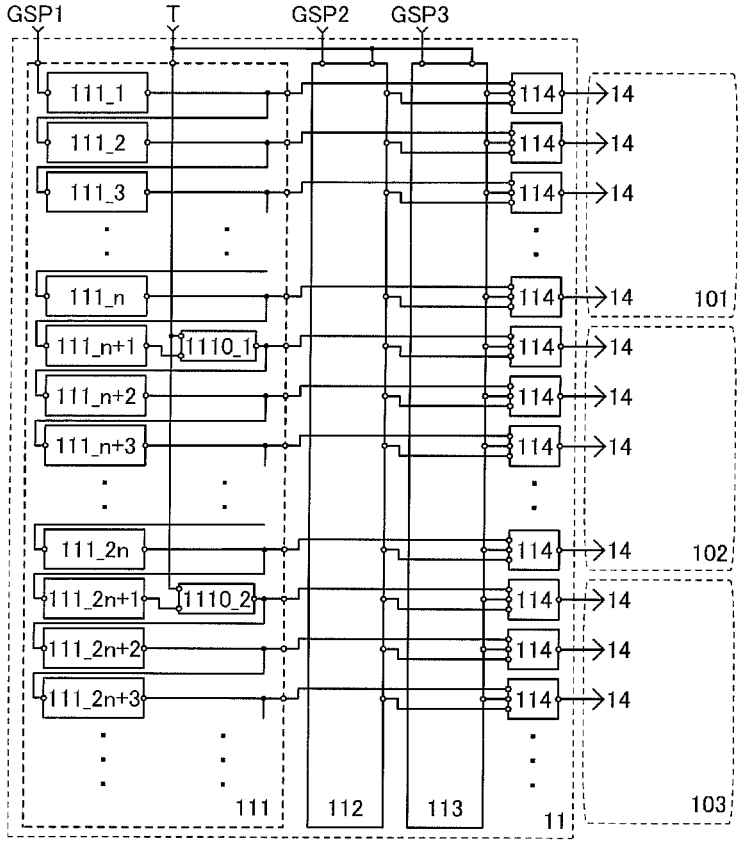
FIG. 2A illustrates a structural example of a scan line driver circuit.

FIG. 2A illustrates a structural example of the scan line driver circuit 11 included in the liquid crystal display device in FIG. 1A. The scan line driver circuit 11 illustrated in FIG. 2A includes shift registers 111 to 113 each having 3n output terminals, and 3n buffers 114 each having three input terminals and one output terminal. Three input terminals of the buffer 114 are electrically connected to different k-th output terminals (k is a natural number of 1 to 3n) of the shift registers 111 to 113. The output terminal of the buffer 114 is electrically connected to the scan line 14 in the k-th row in the pixel portion 10.

The shift register 111 includes pulse output circuits of 3n stages (pulse output circuits 111_1 to 111_3n) and selector circuits 1110_1 and 1110_2. The pulse output circuits 111_1 to 111_3n have a function of sequentially shifting a signal by using the start signal (GSP1) input to the first-stage pulse output circuit, as a trigger (i.e., a function of delaying the signal by a ½ cycle of the clock signal (GCK) and outputting the resulting signal). The selector circuits 1110_1 and 1110_2 each have a function of selecting an output signal of the shift register 111 from an output signal of the pulse output circuit and the low power supply potential (VSS). The selector circuit 1110_1 is provided between the (n+1)th-stage pulse output circuit 111_n+1, the (n+2)th-stage pulse output circuit 111_n+2, and the (n+1)th output terminal of the shift register 111 (the (n+1)th buffer 114). The selector circuit 1110_2 is provided between the (2n+1)th-stage pulse output circuit 111_2 n+1, the (2n+2)th-stage pulse output circuit 111_2n+2, and the (2n+1)th output terminal of the shift register 111 (the (2n+1)th buffer 114). Output terminals of the pulse output circuits 111_1 to 111_n, 111_n+2 to 111_2n, and 111_2n+2 to 111_3n are provided to be directly connected to the corresponding output terminals of the shift register 111 (the corresponding buffers 114). Note that the shift registers 112 and 113 can have a structure similar to that of the shift register 111; therefore, the detailed structures of the shift registers 112 and 113 are not shown in FIG. 2A.

Figure 2B:
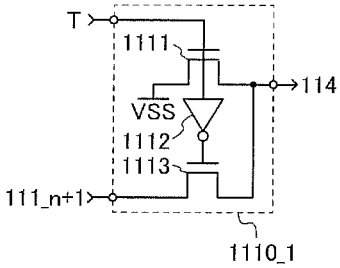
FIG. 2B illustrates a configuration example of a selector circuit.

FIG. 2B illustrates a configuration example of the selector circuit 1110_1 illustrated in FIG. 2A. The selector circuit 1110_1 in FIG. 2B includes a transistor 1111, an inverter 1112, and a transistor 1113. A gate of the transistor 1111 is electrically connected to a wiring that supplies a transfer signal (T). One of a source and a drain of the transistor 1111 is electrically connected to a wiring that supplies the low power supply potential (VSS). The other of the source and the drain of the transistor 1111 is electrically connected to the (n+1)th buffer 114. An input terminal of the inverter 1112 is electrically connected to the wiring that supplies the transfer signal (T). A gate of the transistor 1113 is electrically connected to an output terminal of the inverter 1112. One of a source and a drain of the transistor 1113 is electrically connected to the pulse output circuit 111_n+1. The other of the source and the drain of the transistor 1113 is electrically connected to the other of the source and the drain of the transistor 1111 and the (n+1)th buffer 114. Note that the transfer signal (T) is a signal supplied to the transfer signal line 16 illustrated in FIG. 1A. The selector circuit 1110_2 can have a structure similar to that of the selector circuit 1110_1.

Figure 2C:
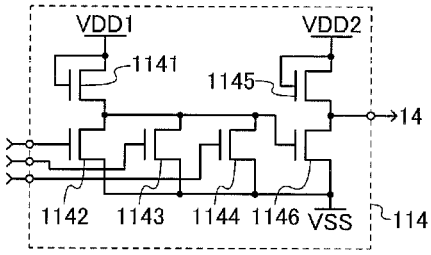
FIG. 2C illustrates a configuration example of a buffer.

FIG. 2C illustrates a configuration example of the buffer 114 illustrated in FIG. 2A. Simply put, the buffer 114 in FIG. 2C is a three-input OR gate. Note that as for the two high power supply potentials (VDD1 and VDD2) used in the buffer 114 in FIG. 2C, the high power supply potential (VDD2) is higher than the high power supply potential (VDD1).

The buffer 114 in FIG. 2C includes a transistor 1141, a transistor 1142, a transistor 1143, a transistor 1144, a transistor 1145, and a transistor 1146. A gate and one of a source and a drain of the transistor 1141 are electrically connected to a wiring that supplies the high power supply potential (VDD1). A gate of the transistor 1142 is electrically connected to a first input terminal of the buffer 114. One of a source and a drain of the transistor 1142 is electrically connected to the other of the source and the drain of the transistor 1141. The other of the source and the drain of the transistor 1142 is electrically connected to a wiring that supplies the low power supply potential (VSS). A gate of the transistor 1143 is electrically connected to a second input terminal of the buffer 114. One of a source and a drain of the transistor 1143 is electrically connected to the other of the source and the drain of the transistor 1141 and one of the source and the drain of the transistor 1142. The other of the source and the drain of the transistor 1143 is electrically connected to the wiring that supplies the low power supply potential (VSS). A gate of the transistor 1144 is electrically connected to a third input terminal of the buffer 114. One of a source and a drain of the transistor 1144 is electrically connected to the other of the source and the drain of the transistor 1141, one of the source and the drain of the transistor 1142, and one of the source and the drain of the transistor 1143. The other of the source and the drain of the transistor 1144 is electrically connected to the wiring that supplies the low power supply potential (VSS). A gate and one of a source and a drain of the transistor 1145 are electrically connected to a wiring that supplies the high power supply potential (VDD2). The other of the source and the drain of the transistor 1145 is electrically connected to the scan line 14. A gate of the transistor 1146 is electrically connected to the other of the source and the drain of the transistor 1141, one of the source and the drain of the transistor 1142, one of the source and the drain of the transistor 1143, and one of the source and the drain of the transistor 1144. One of a source and a drain of the transistor 1146 is electrically connected to the other of the source and the drain of the transistor 1145 and the scan line 14. The other of the source and the drain of the transistor 1146 is electrically connected to the wiring that supplies the low power supply potential (VSS).

(Operation Example of Scan Line Driver Circuit 11)

Figure 3:
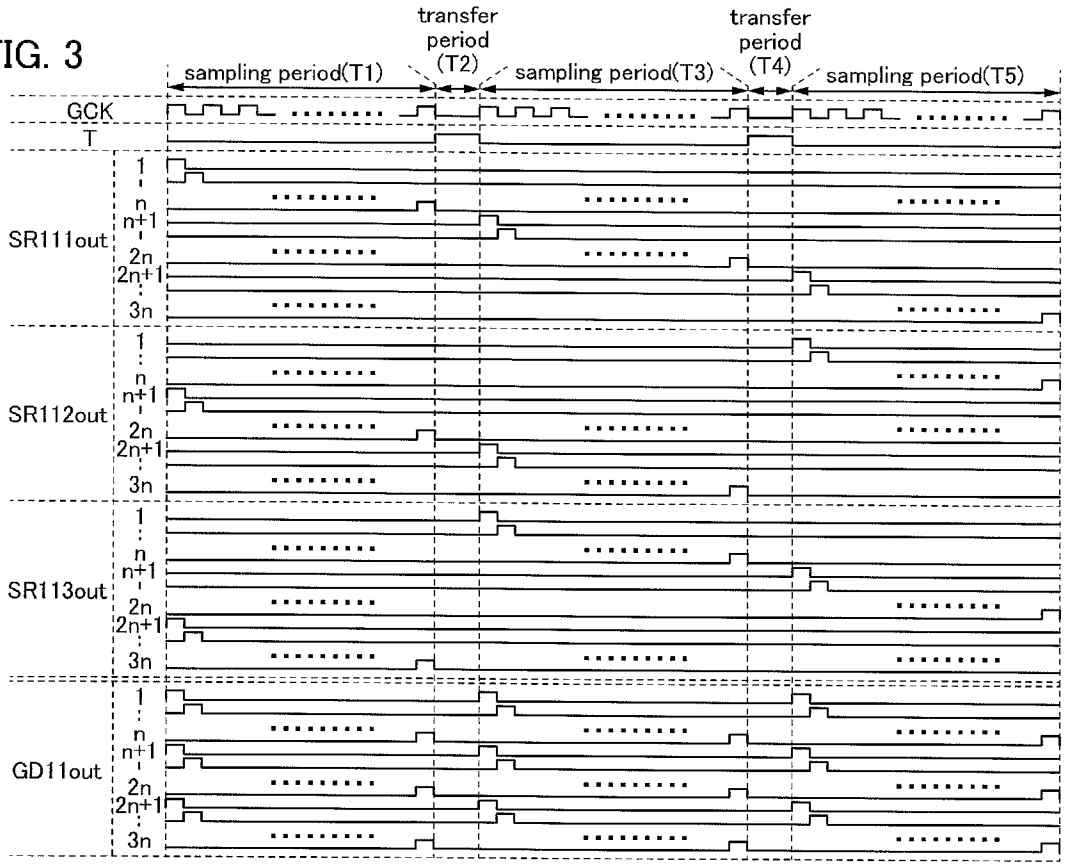
FIG. 3 illustrates operation of a scan line driver circuit.

An operation example of the scan line driver circuit 11 will be described with reference to FIG. 3. FIG. 3 shows the clock signal (GCK) for the scan line driver circuit, the transfer signal (T), signals (SR111out) output from the 3n output terminals of the shift register 111, signals (SR112out) output from the 3n output terminals of the shift register 112, signals (SR113out) output from the 3n output terminals of the shift register 113, and signals (GD11out) output from 3n output terminals of the scan line driver circuit.

In a sampling period (T1), the transfer signal (T) has a low-level potential, so that the potential of GD11out is set at high level when any of SR111out, SR112out, and SR113out has a high-level potential. Here, in the shift register 111, a high-level potential is sequentially shifted every ½ clock cycle (horizontal scan period) from the first-stage pulse output circuit 111_1 to the n-th-stage pulse output circuit 111_n. In the shift register 112, a high-level potential is sequentially shifted every ½ clock cycle (horizontal scan period) from the (n+1)th-stage pulse output circuit to the 2n-th-stage pulse output circuit. In the shift register 113, a high-level potential is sequentially shifted every ½ clock cycle (horizontal scan period) from the (2n+1)th-stage pulse output circuit to the 3n-th-stage pulse output circuit. Thus, the scan line driver circuit 11 supplies selection signals to three different scan lines 14 depending on horizontal scan periods.

In a transfer period (T2), the transfer signal (T) has a high-level potential (is a selection signal), so that all the potentials of GD11out are set at low level. Note that in the shift registers 111 to 113, the following operation needs to be performed: the shift of a selection signal is temporarily stopped in the transfer period (T2) and restarted in a sampling period (T3) subsequent to the transfer period (T2). In order to realize such operation in the shift registers 111 to 113, the shift registers are designed, for example, so that a pulse output circuit starts an output operation of a high-level potential in accordance with input of a high-level potential output from the previous-stage pulse output circuit, and stops in accordance with input of a high-level potential output from the subsequent-stage pulse output circuit.

In the sampling period (T3), the transfer signal (T) has a low-level potential as in the sampling period (T1), so that the potential of GD11out is set at high level when any of SR111out, SR112out, and SR113out has a high-level potential. Here, although output signals of the shift registers 111 to 113 are different from those in the sampling period (T1), a combination of the output signals is the same as in the sampling period (T1). That is, in one of the shift registers 111 to 113 (the shift register 113 in the sampling period (T3)), a high-level potential is sequentially shifted every ½ clock cycle (horizontal scan period) from the first-stage pulse output circuit 111_1 to the n-th-stage pulse output circuit 111_n. In another one of the shift registers 111 to 113 (the shift register 111 in the sampling period (T3)), a high-level potential is sequentially shifted every ½ clock cycle (horizontal scan period) from the (n+1)th-stage pulse output circuit to the 2n-th-stage pulse output circuit. In the other of the shift registers 111 to 113 (the shift register 112 in the sampling period (T3)), a high-level potential is sequentially shifted every ½ clock cycle (horizontal scan period) from the (2n+1)th-stage pulse output circuit to the 3n-th-stage pulse output circuit. Thus, as in the sampling period (T1), the scan line driver circuit 11 supplies selection signals to three different scan lines 14 depending on horizontal scan periods.

(Structural Example of Signal Line Driver Circuit 12)

Figure 4A:
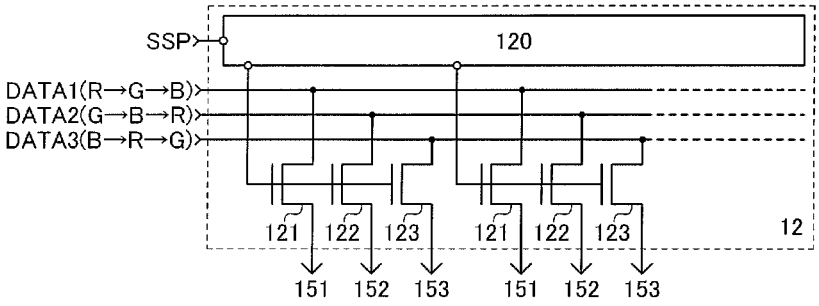
FIG. 4A illustrates a structural example of a signal line driver circuit.

FIG. 4A illustrates a structural example of the signal line driver circuit 12 included in the liquid crystal display device in FIG. 1A. The signal line driver circuit 12 in FIG. 4A includes a shift register 120 having m output terminals, m transistors 121, m transistors 122, and in transistors 123. A gate of the transistor 121 is electrically connected to the j-th output terminal (j is a natural number of 1 to m) of the shift register 120. One of a source and a drain of the transistor 121 is electrically connected to a wiring that supplies the first image signal (DATA1). The other of the source and the drain of the transistor 121 is electrically connected to the signal line 151 in the j-th column in the pixel portion 10. A gate of the transistor 122 is electrically connected to the j-th output terminal of the shift register 120. One of a source and a drain of the transistor 122 is electrically connected to a wiring that supplies the second image signal (DATA2). The other of the source and the drain of the transistor 122 is electrically connected to the signal line 152 in the j-th column in the pixel portion 10. A gate of the transistor 123 is electrically connected to the j-th output terminal of the shift register 120. One of a source and a drain of the transistor 123 is electrically connected to a wiring that supplies the third image signal (DATA3). The other of the source and the drain of the transistor 123 is electrically connected to the signal line 153 in the j-th column in the pixel portion 10.

The first image signal (DATA1) is supplied to the signal line 151 through the transistor 121. That is, the first image signal (DATA1) is an image signal for the region 101 in the pixel portion 10. Similarly, the second image signal (DATA2) is an image signal for the region 102 in the pixel portion 10, and the third image signal (DATA3) is an image signal for the region 103 in the pixel portion 10. Here, as the first image signal (DATA1), a red (R) image signal, a green (G) image signal, and a blue (B) image signal are supplied to the signal line 151 in the sampling period (T1), the sampling period (T3), and a sampling period (T5), respectively. As the second image signal (DATA2), a green (G) image signal, a blue (B) image signal, and a red (R) image signal are supplied to the signal line 152 in the sampling period (T1), the sampling period (T3), and the sampling period (T5), respectively. As the third image signal (DATA3), a blue (B) image signal, a red (R) image signal, and a green (G) image signal are supplied to the signal line 153 in the sampling period (T1), the sampling period (T3), and the sampling period (T5), respectively.

Figure 4B:
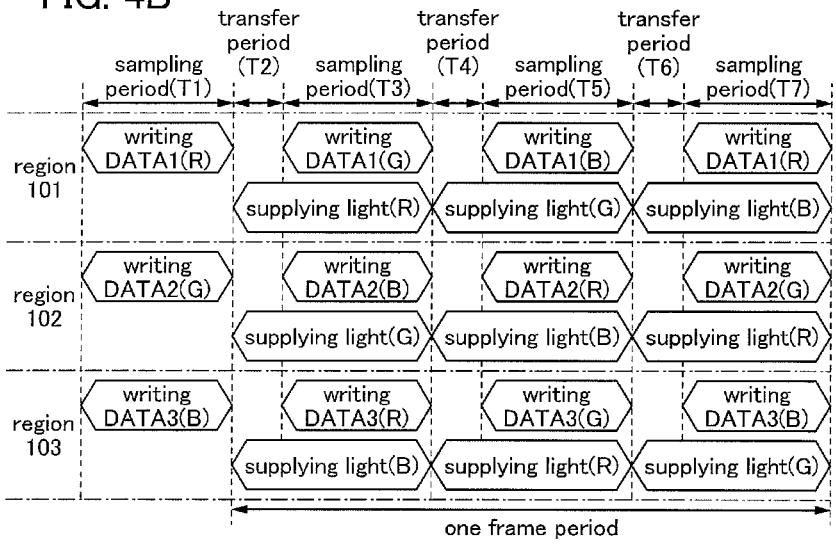
FIG. 4B illustrates an operation example of a liquid crystal display device.

FIG. 4B illustrates an operation example of the liquid crystal display device. FIG. 4B shows change over time in image signals written into the regions 101, 102, and 103 and lights supplied to the regions 101, 102, and 103. As illustrated in FIG. 4B, in the liquid crystal display device, writing of image signals and supply of light of a given color can be simultaneously performed in each region (each of the regions 101, 102, and 103). In the liquid crystal display device, one image is produced in the pixel portion 10 by the operations in the transfer period (T2) to a sampling period (T7). That is, in the liquid crystal display device, the period from the transfer period (T2) to the sampling period (T7) corresponds to one frame period.

(Liquid Crystal Display Device Disclosed in this Specification)

In the liquid crystal display device disclosed in this specification, a plurality of scan lines can be selected at the same time. That is, in the liquid crystal display device, image signals can be simultaneously supplied to pixels placed in a plurality of rows, among the pixels arranged in matrix. Thus, the frequency of input of an image signal to each pixel can be increased without change in response speed of a transistor or the like included in the liquid crystal display device. Specifically, in the liquid crystal display device, the frequency of input of an image signal to each pixel can be tripled without change in clock frequency or the like of the scan line driver circuit. In other words, the liquid crystal display device is preferably applied to a liquid crystal display device in which images are displayed by a field sequential method or a liquid crystal display device driven by high frame rate driving.

The liquid crystal display device disclosed in this specification is preferably applied to a liquid crystal display device in which images are displayed by a field sequential method because of the following reasons. As described above, in a liquid crystal display device in which images are displayed by a field sequential method, a display period is divided by lights of given colors. For that reason, display perceived by a user is sometimes changed (degraded) from display based on original display information (such a phenomenon is also referred to as color breaks) because of a lack of a given piece of display information due to temporary interruption of display, such as a blink of the user. An increase in frame frequency is effective in reducing color breaks. Further, in order to perform display by a field sequential method, the frequency of input of an image signal to each pixel needs to be higher than the frame frequency. For that reason, in the case where images are displayed with a field sequential method and high frame frequency driving in a conventional liquid crystal display device, requirements for performance (high-speed response) of elements in the liquid crystal display device are extremely strict. In contrast, in the liquid crystal display device disclosed in this specification, the frequency of input of an image signal to each pixel can be increased regardless of characteristics of elements. Therefore, color breaks in the liquid crystal display device in which images are displayed by a field sequential method can be easily reduced.

In addition, in the case where display is performed by a field sequential method, it is preferable to supply lights of different colors depending on regions as illustrated in FIG. 4B because of the following reasons. In the case where light of one color is supplied for the entire screen, the pixel portion only has information on a specific color at a given moment. Therefore, a lack of display information in a given period due to a blink of the user or the like corresponds to a lack of information on a specific color. In contrast, in the case where lights of different colors are supplied depending on regions, the pixel portion has information on the colors at a given moment. Therefore, a lack of display information in a given period due to a blink of the user or the like does not correspond to a lack of information on a specific color. In other words, color breaks can be reduced by supplying lights of different colors depending on regions.

(Variations)

The liquid crystal display device having the above-described structure is one embodiment of the present invention; the present invention also includes a liquid crystal display device that is different from the liquid crystal display device.

For example, the above-described liquid crystal display device has the structure in which the pixel portion 10 is divided into three regions (the regions 101, 102, and 103) (see FIG. 1A); however, the liquid crystal display device of the present invention is not limited to having this structure. That is, in the liquid crystal display device of the present invention, the pixel portion 10 can be divided into a given number of regions. Although obvious, it is to be noted that in the case where the number of regions is changed, it is necessary to provide signal lines, shift registers, and the like as many as the regions.

In the liquid crystal display device, three kinds of light sources, each of which emits one of red (R) light, green (G) light, and blue (B) light, are used as a plurality of light sources; however, the liquid crystal display device of the present invention is not limited to having this structure. That is, in the liquid crystal display device of the present invention, light sources that emit lights of given colors can be used in combination. For example, it is possible to use a combination of four kinds of light sources that emit lights of red (R), green (G), blue (B), and white (W); or a combination of three kinds of light sources that emit lights of cyan, magenta, and yellow. Moreover, it is possible to use a combination of six kinds of light sources that emit lights of light red (R), light green (G), light blue (B), dark red (R), dark green (G), and dark blue (B); or a combination of six kinds of light sources that emit lights of red (R), green (G), blue (B), cyan, magenta, and yellow.

The liquid crystal display device has the structure in which a capacitor for holding a voltage applied to the liquid crystal element is not provided (see FIGS. 1B to 1D); alternatively, the capacitor can be provided in the liquid crystal display device.

Furthermore, the liquid crystal display device has the structure in which the transfer signal (T) is input to the selector circuit (see FIGS. 2A and 2B); alternatively, a signal input to the selector circuit may be a signal different from the transfer signal (T). Specifically, a signal input to the selector circuit can be any signal that has a high-level potential in a period including a period during which the potential of the transfer signal (T) is set at high level.

Figure 5A:
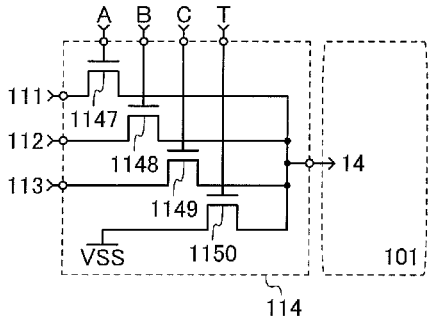
FIG. 5A illustrates a variation of a buffer.
Figure 5B:
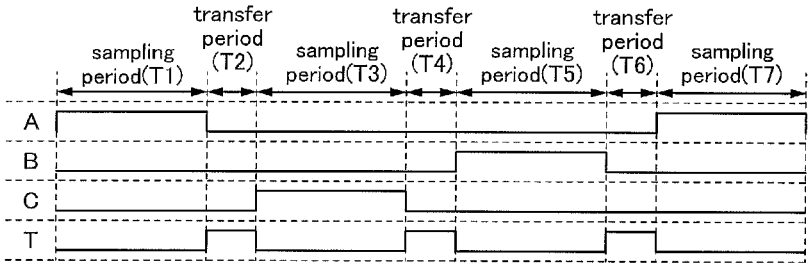
FIG. 5B illustrates change in potential of signals.

In addition, in the liquid crystal display device, a three-input OR gate is used as the buffer (see FIG. 2C); however, the buffer is not limited to having this structure. As the buffer 114 electrically connected to the scan line 14 placed in the region 101, a circuit illustrated in FIG. 5A can be used, for example. The buffer 114 illustrated in FIG. 5A includes a transistor 1147, a transistor 1148, a transistor 1149, and a transistor 1150. A gate of the transistor 1147 is electrically connected to a wiring that supplies a signal (A). One of a source and a drain of the transistor 1147 is electrically connected to the shift register 111. The other of the source and the drain of the transistor 1147 is electrically connected to the scan line 14. A gate of the transistor 1148 is electrically connected to a wiring that supplies a signal (B). One of a source and a drain of the transistor 1148 is electrically connected to the shift register 112. The other of the source and the drain of the transistor 1148 is electrically connected to the scan line 14. A gate of the transistor 1149 is electrically connected to a wiring that supplies a signal (C). One of a source and a drain of the transistor 1149 is electrically connected to the shift register 113. The other of the source and the drain of the transistor 1149 is electrically connected to the scan line 14. A gate of the transistor 1150 is electrically connected to a wiring that supplies the transfer signal (T). One of a source and a drain of the transistor 1150 is electrically connected to a wiring that supplies the low power supply potential (VSS). The other of the source and the drain of the transistor 1150 is electrically connected to the scan line 14. Note that the signal (A), the signal (B), and the signal (C) are signals whose potentials are changed as illustrated in FIG. 5B. A combination of electrical connections between the gates of the transistors and the wirings that supply the signal (A), the signal (B), and the signal (C) is changed as appropriate in the circuit in FIG. 5A, whereby the circuit in FIG. 5A can be used as the buffer 114 that is electrically connected to the scan line 14 placed in the region 102, or the buffer 114 that is electrically connected to the scan line 14 placed in the region 103.

(Example of Transistor)

A structural example of a transistor included in the liquid crystal display device will be described below with reference to FIG. 6. Note that in the liquid crystal display device, a transistor provided in the pixel portion 10 and a transistor provided in the scan line driver circuit 11 may have the same structure or different structures.

Figure 6:
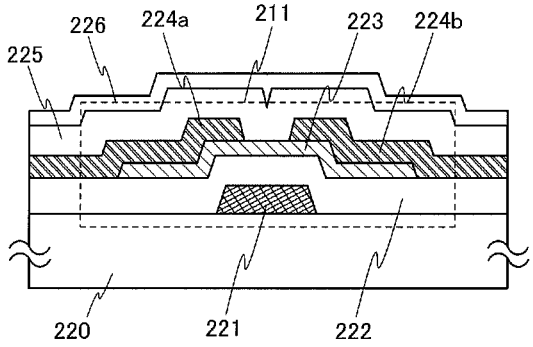
FIG. 6 illustrates a structural example of a transistor.

A transistor 211 illustrated in FIG. 6 includes a gate layer 221 provided over a substrate 220 having an insulating surface, a gate insulating layer 222 provided over the gate layer 221, a semiconductor layer 223 provided over the gate insulating layer 222, and a source layer 224*a* and a drain layer 224*b* provided over the semiconductor layer 223. Moreover, FIG. 6 illustrates an insulating layer 225 that covers the transistor 211 and is in contact with the semiconductor layer 223, and a protective insulating layer 226 provided over the insulating layer 225.

Examples of the substrate 220 are a semiconductor substrate (e.g., a single crystal substrate and a silicon substrate), an SOI substrate, a glass substrate, a quartz substrate, a conductive substrate having a surface on which an insulating layer is formed, and a flexible substrate such as a plastic substrate, a bonding film, paper containing a fibrous material, and a base film. Examples of a glass substrate are a barium borosilicate glass substrate, an aluminoborosilicate glass substrate, and a soda lime glass substrate. For a flexible substrate, a flexible synthetic resin such as plastics typified by polyethylene terephthalate (PET), polyethylene naphthalate (PEN), and polyether sulfone (PES), or acrylic can be used, for example.

For the gate layer 221, an element selected from aluminum (Al), copper (Cu), titanium (Ti), tantalum (Ta), tungsten (W), molybdenum (Mo), chromium (Cr), neodymium (Nd), and scandium (Sc); an alloy containing any of these elements; or a nitride containing any of these elements can be used. Alternatively, the gate layer 221 can have a stacked structure of any of these materials.

For the gate insulating layer 222, an insulator such as silicon oxide, silicon nitride, silicon oxynitride, silicon nitride oxide, aluminum oxide, or tantalum oxide can be used. A stacked structure of any of these materials can also be used. Note that silicon oxynitride refers to a material that contains more oxygen than nitrogen and contains oxygen, nitrogen, silicon, and hydrogen at given concentrations ranging from 55 to 65 atomic %, 1 to 20 atomic %, 25 to 35 atomic %, and 0.1 to 10 atomic %, respectively, where the total percentage of atoms is 100 atomic %. Further, silicon nitride oxide refers to a material that contains more nitrogen than oxygen and contains oxygen, nitrogen, silicon, and hydrogen at given concentrations ranging from 15 to 30 atomic %, 20 to 35 atomic %, 25 to 35 atomic %, and 15 to 25 atomic %, respectively, where the total percentage of atoms is 100 atomic %.

The semiconductor layer 223 can be formed using any of the following semiconductor materials, for example: a material containing an element belonging to Group 14 of the periodic table, such as silicon (Si) or germanium (Ge), as its main component; a compound such as silicon germanium (SiGe) or gallium arsenide (GaAs); an oxide such as zinc oxide (ZnO) or zinc oxide containing indium (In) and gallium (Ga); or an organic compound exhibiting semiconductor characteristics. Alternatively, the semiconductor layer 223 can have a stacked structure of layers formed using any of these semiconductor materials.

Moreover, in the case where an oxide (an oxide semiconductor) is used for the semiconductor layer 223, any of the following oxide semiconductors can be used: an In—Sn—Ga—Zn—O-based oxide semiconductor which is an oxide of four metal elements; an In—Ga—Zn—O-based oxide semiconductor, an In—Sn—Zn—O-based oxide semiconductor, an In—Al—Zn—O-based oxide semiconductor, a Sn—Ga—Zn—O-based oxide semiconductor, an Al—Ga—Zn—O-based oxide semiconductor, and a Sn—Al—Zn—O-based oxide semiconductor which are oxides of three metal elements; an In—Ga—O-based oxide, an In—Zn—O-based oxide semiconductor, a Sn—Zn—O-based oxide semiconductor, an Al—Zn—O-based oxide semiconductor, a Zn—Mg—O-based oxide semiconductor, a Sn—Mg—O-based oxide semiconductor, and an In—Mg—O-based oxide semiconductor which are oxides of two metal elements; and an In—O-based oxide semiconductor, a Sn—O-based oxide semiconductor, and a Zn—O-based oxide semiconductor which are oxides of one metal element. Further, $SiO_2$ may be contained in the above oxide semiconductor. Here, for example, an In—Ga—Zn—O-based oxide semiconductor is an oxide containing at least In, Ga, and Zn, and there is no particular limitation on the composition ratio of the elements. An In—Ga—Zn—O-based oxide semiconductor may contain an element other than In, Ga, and Zn.

As the semiconductor layer 223, a thin film expressed by a chemical formula of $InMO_3(ZnO)_m$, (m>0) can be used. Here, M represents one or more metal elements selected from Ga, Al, Mn, and Co. For example, M can be Ga, Ga and Al, Ga and Mn, or Ga and Co.

In the case where an In—Zn—O-based material is used as an oxide semiconductor, a target to be used has a composition ratio of In:Zn=50:1 to 1:2 in an atomic ratio ($In_2O_3$:ZnO=25:1 to 1:4 in a molar ratio), preferably In:Zn=20:1 to 1:1 in an atomic ratio ($In_2O_3$:ZnO=10:1 to 1:2 in a molar ratio), further preferably In:Zn=15:1 to 1.5:1 in an atomic ratio ($In_2O_3$:ZnO=15:2 to 3:4 in a molar ratio). For example, when a target used for forming an In—Zn—O-based oxide semiconductor has an atomic ratio of In:Zn:O=X:Y:Z, the relation of Z>(1.5X+Y) is satisfied.

For the source layer 224*a* and the drain layer 224*b*, an element selected from aluminum (Al), copper (Cu), titanium (Ti), tantalum (Ta), tungsten (W), molybdenum (Mo), chromium (Cr), neodymium (Nd), and scandium (Sc); an alloy containing any of these elements; or a nitride containing any of these elements can be used. Alternatively, the source layer 224*a* and the drain layer 224*b* can have a stacked structure of any of these materials.

A conductive film to be the source layer 224*a* and the drain layer 224*b* (including a wiring layer formed using the same layer as the source and drain layers) may be formed using a conductive metal oxide. As the conductive metal oxide, indium oxide ($In_2O_3$), tin oxide ($SnO_2$), zinc oxide (ZnO), an alloy of indium oxide and tin oxide ($In_2O_3$—$SnO_2$, referred to as ITO), an alloy of indium oxide and zinc oxide ($In_2O_3$—ZnO), or any of these metal oxide materials containing silicon or silicon oxide can be used.

For the insulating layer 225, an insulator such as silicon oxide, silicon oxynitride, aluminum oxide, or aluminum oxynitride can be used. A stacked structure of any of these materials can also be used.

For the protective insulating layer 226, an insulator such as silicon nitride, aluminum nitride, silicon nitride oxide, or aluminum nitride oxide can be used. A stacked structure of any of these materials can also be used.

A planarization insulating film may be formed over the protective insulating layer 226 in order to reduce surface roughness due to the transistor. The planarization insulating film can be formed using an organic material such as polyimide, acrylic, or benzocyclobutene. Other than such organic materials, it is possible to use a low-dielectric constant material (low-k material) or the like. Note that the planarization insulating film may be formed by stacking a plurality of insulating films formed from these materials.

The liquid crystal display device disclosed in this specification can be formed using a transistor having the above-described structure. For example, a transistor including a semiconductor layer formed of amorphous silicon can be used in the pixel portion 10, and a transistor including a semiconductor layer formed of polycrystalline silicon or single crystal silicon can be used in the scan line driver circuit 11. Alternatively, a transistor including a semiconductor layer formed of an oxide semiconductor can be used in the pixel portion 10 and the scan line driver circuit 11. In the case where transistors having the same structure are used in the pixel portion 10 and the scan line driver circuit 11, reduction in cost and increase in yield due to reduction in the number of manufacturing steps can be achieved.

(Variations of Transistor)

FIG. 6 illustrates the transistor 211 with a bottom-gate structure called a channel-etch structure; however, the transistor provided in the liquid crystal display device is not limited to having this structure. Transistors illustrated in FIGS. 7A to 7C can be used, for example.

Figure 7A:
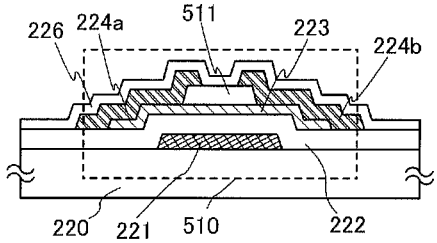
FIGS. 7A to 7C each illustrate a structural example of a transistor.

A transistor 510 illustrated in FIG. 7A has a kind of bottom-gate structure called a channel-protective type (channel-stop type).

The transistor 510 includes, over a substrate 220 having an insulating surface, a gate layer 221, a gate insulating layer 222, a semiconductor layer 223, an insulating layer 511 functioning as a channel protective layer that covers a channel formation region of the semiconductor layer 223, a source layer 224*a*, and a drain layer 224*b*. Moreover, a protective insulating layer 226 is formed to cover the source layer 224*a*, the drain layer 224*b*, and the insulating layer 511.

As the insulating layer 511, an insulator such as silicon oxide, silicon nitride, silicon oxynitride, silicon nitride oxide, aluminum oxide, or tantalum oxide can be used. Alternatively, the insulating layer 511 can have a stacked structure of any of these materials.

Figure 7B:
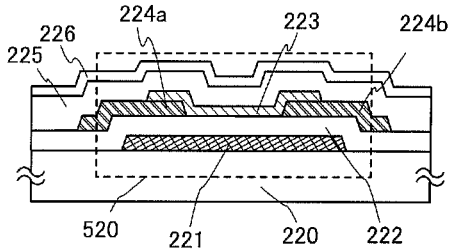

A transistor 520 illustrated in FIG. 7B is a bottom-gate transistor. The transistor 520 includes, over a substrate 220 having an insulating surface, a gate layer 221, a gate insulating layer 222, a source layer 224*a*, a drain layer 224*b*, and a semiconductor layer 223. Furthermore, an insulating layer 225 that covers the source layer 224*a* and the drain layer 224*b* and is in contact with the semiconductor layer 223 is provided. A protective insulating layer 226 is provided over the insulating layer 225.

In the transistor 520, the gate insulating layer 222 is provided on and in contact with the substrate 220 and the gate layer 221, and the source layer 224*a* and the drain layer 224*b* are provided on and in contact with the gate insulating layer 222. Further, the semiconductor layer 223 is provided over the gate insulating layer 222, the source layer 224*a*, and the drain layer 224*b*.

Figure 7C:
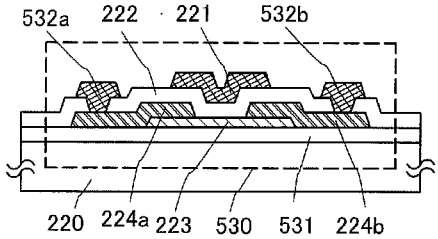

A transistor 530 illustrated in FIG. 7C is a kind of top-gate transistor. The transistor 530 includes, over a substrate 220 having an insulating surface, an insulating layer 531, a semiconductor layer 223, a source layer 224*a* and a drain layer

224*b*, a gate insulating layer 222, and a gate layer 221. A wiring layer 532*a* and a wiring layer 532*b* are provided in contact with the source layer 224*a* and the drain layer 224*b*, to be electrically connected to the source layer 224*a* and the drain layer 224*b*, respectively.

As the insulating layer 531, an insulator such as silicon oxide, silicon nitride, silicon oxynitride, silicon nitride oxide, aluminum oxide, or tantalum oxide can be used. Alternatively, the insulating layer 531 can have a stacked structure of any of these materials.

The wiring layers 532*a* and 532*b* can be formed using an element selected from aluminum (Al), copper (Cu), titanium (Ti), tantalum (Ta), tungsten (W), molybdenum (Mo), chromium (Cr), neodymium (Nd), and scandium (Sc); an alloy containing any of these elements; or a nitride containing any of these elements. Alternatively, the wiring layers 532*a* and 5326 can have a stacked structure of any of these materials.

(Various Electronic Devices Including Display Device)

Examples of electronic devices including any of the display devices disclosed in this specification will be described below with reference to FIGS. 8A to 8F.

Figure 8A:
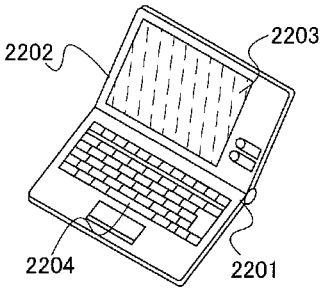
FIGS. 8A to 8F each illustrate an example of an electronic device.

FIG. 8A illustrates a notebook personal computer including a main body 2201, a housing 2202, a display portion 2203, a keyboard 2204, and the like.

Figure 8B:
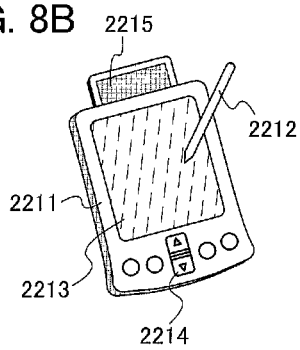

FIG. 8B illustrates a personal digital assistant (PDA). A main body 2211 is provided with a display portion 2213, an external interface 2215, operation buttons 2214, and the like. A stylus 2212 is provided as an accessory for operating the PDA.

Figure 8C:
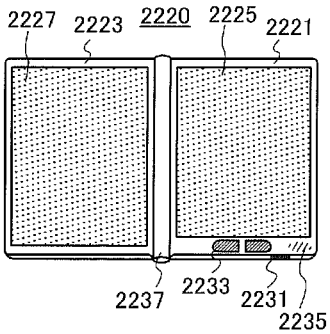

FIG. 8C illustrates an e-book reader 2220 as an example of electronic paper. The e-book reader 2220 includes two housings of a housing 2221 and a housing 2223. The housings 2221 and 2223 are united with an axis portion 2237, along which the e-book reader 2220 can be opened and closed. With such a structure, the e-book reader 2220 can be used like a paper book.

A display portion 2225 is incorporated in the housing 2221, and a display portion 2227 is incorporated in the housing 2223. The display portion 2225 and the display portion 2227 may display one image or different images. In the case where the display portions 2225 and 2227 display different images, for example, the right display portion (the display portion 2225 in FIG. 8C) can display text and the left display portion (the display portion 2227 in FIG. 8C) can display pictures.

Further, in FIG. 8C, the housing 2221 is provided with an operation portion and the like. For example, the housing 2221 is provided with a power switch 2231, an operation key 2233, and a speaker 2235. Pages can be turned with the operation key 2233. Note that a keyboard, a pointing device, or the like may also be provided on the surface of the housing, on which the display portion is provided. An external connection terminal (e.g., an earphone terminal, a USB terminal, or a terminal that can be connected to an AC adapter or various cables such as a USB cable), a recording medium insertion portion, and the like may be provided on the back surface or the side surface of the housing. Further, the e-book reader 2220 may have a function of an electronic dictionary.

The e-book reader 2220 may be configured to transmit and receive data wirelessly. Through wireless communication, desired book data or the like can be purchased and downloaded from an e-book server.

Note that electronic paper can be applied to devices in a variety of fields as long as they display data. For example, electronic paper can be used for posters, advertisement in vehicles such as trains, and display in a variety of cards such as credit cards in addition to e-book readers.

Figure 8D:
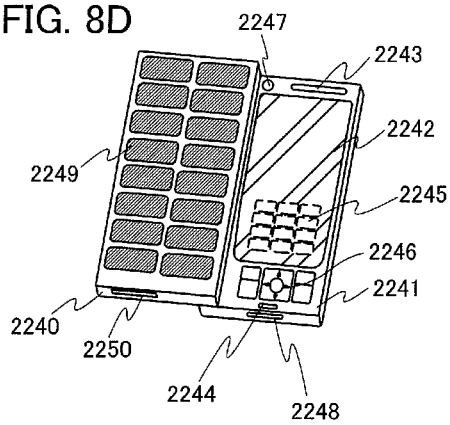

FIG. 8D illustrates a mobile phone. The mobile phone includes two housings of a housing 2240 and a housing 2241. The housing 2241 is provided with a display panel 2242, a speaker 2243, a microphone 2244, a pointing device 2246, a camera lens 2247, an external connection terminal 2248, and the like. The housing 2240 is provided with a solar cell 2249 for charging the mobile phone, an external memory slot 2250, and the like. An antenna is incorporated in the housing 2241.

The display panel 2242 has a touch panel function. In FIG. 8D, a plurality of operation keys 2245 displayed as images are shown by dashed lines. Note that the mobile phone includes a booster circuit for increasing a voltage output from the solar cell 2249 to a voltage needed for each circuit. Moreover, the mobile phone can include a contactless IC chip, a small recording device, or the like in addition to the above components.

The display orientation of the display panel 2242 changes as appropriate in accordance with the application mode. Further, the camera lens 2247 is provided on the same surface as the display panel 2242, so that the mobile phone can be used as a video phone. The speaker 2243 and the microphone 2244 can be used for videophone calls, recording, playing sound, and the like as well as voice calls. The housings 2240 and 2241 which are unfolded as illustrated in FIG. 8D can slide so that one overlaps the other. Thus, the size of the mobile phone can be reduced, which makes the mobile phone suitable for being carried.

The external connection terminal 2248 can be connected to an AC adapter or a variety of cables such as a USB cable, which enables charging of the mobile phone and data communication. Moreover, a larger amount of data can be saved and moved by inserting a recording medium to the external memory slot 2250. Further, the mobile phone may have an infrared communication function, a television reception function, or the like in addition to the above functions.

Figure 8E:
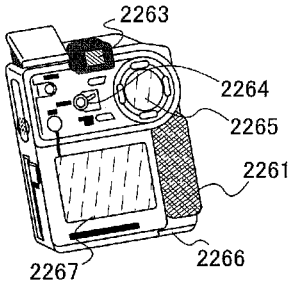

FIG. 8E illustrates a digital camera. The digital camera includes a main body 2261, a display portion (A) 2267, an eyepiece 2263, an operation switch 2264, a display portion (B) 2265, a battery 2266, and the like.

Figure 8F:
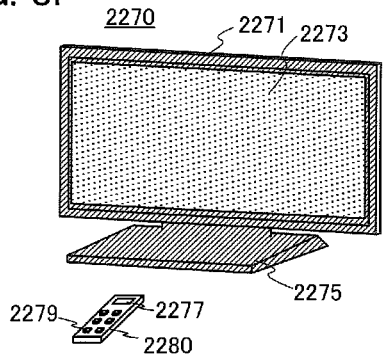

FIG. 8F illustrates a television set. In a television set 2270, a display portion 2273 is incorporated in a housing 2271. The display portion 2273 can display images. Here, the housing 2271 is supported by a stand 2275.

The television set 2270 can be operated by an operation switch of the housing 2271 or a separate remote controller 2280. With operation keys 2279 of the remote controller 2280, channels and volume can be controlled and an image displayed on the display portion 2273 can be controlled. Moreover, the remote controller 2280 may have a display portion 2277 that displays data output from the remote controller 2280.

Note that the television set 2270 is preferably provided with a receiver, a modem, and the like. A general television broadcast can be received with the receiver. Moreover, when the television set is connected to a communication network with or without wires via the modem, one-way (from a sender to a receiver) or two-way (between a sender and a receiver or between receivers) data communication can be performed.

This application is based on Japanese Patent Application serial no. 2010-083480 filed with Japan Patent Office on Mar. 31, 2010, the entire contents of which are hereby incorporated by reference.

Explanation Of Reference

10: pixel portion, 11: scan line driver circuit, 12: signal line driver circuit, 13: transfer signal line driver circuit, 14: scan line, 16: transfer signal line, 101: region, 102: region, 103: region, 111: shift register, 111_1 to 111_3n: pulse output circuit, 112: shift register, 113: shift register, 114: buffer, 120: shift register, 121: transistor, 122: transistor, 123: transistor, 151: signal line, 152: signal line, 153: signal line, 171: pixel, 172: pixel, 173: pixel, 211: transistor, 220: substrate, 221: gate layer, 222: gate insulating layer, 223: semiconductor layer, 224*a*: source layer, 224*b*: drain layer, 225: insulating layer, 226: protective insulating layer, 510: transistor, 511: insulating layer, 520: transistor, 530: transistor, 531: insulating layer, 532*a*: wiring layer, 532*b*: wiring layer, 1110_1: selector circuit, 11102: selector circuit, 1111: transistor, 1112: inverter, 1113: transistor, 1141: transistor, 1142: transistor, 1143: transistor, 1144: transistor, 1145: transistor, 1146: transistor, 1147: transistor, 1148: transistor, 1149: transistor, 1150: transistor, 1711: transistor, 1712: capacitor, 1713: transistor, 1714: liquid crystal element, 1721: transistor, 1731: transistor, 2201: main body, 2202: housing, 2203: display portion, 2204: keyboard, 2211: main body, 2212: stylus, 2213: display portion, 2214: operation button, 2215: external interface, 2220: e-book reader 2221: housing, 2223: housing, 2225: display portion, 2227: display portion, 2231: power switch, 2233: operation key, 2235: speaker, 2237: axis portion, 2240: housing, 2241: housing, 2242: display panel, 2243: speaker, 2244: microphone, 2245: operation key, 2246: pointing device, 2247: camera lens, 2248: external connection terminal, 2249: solar cell, 2250: external memory slot, 2261: main body, 2263: eyepiece, 2264: operation switch, 2265: display portion (B), 2266: battery, 2267: display portion (A), 2270: television set, 2271: housing, 2273: display portion, 2275: stand, 2277: display portion, 2279: operation key, 2280: remote controller

The invention claimed is:

1. A display device comprising:

a scan line driver circuit comprising a first shift register, a second shift register, a first selector circuit, and a second selector circuit;

a pixel portion comprising a first region and a second region;

a first scan line electrically connected to a first pixel in the first region;

a second scan line electrically connected to a second pixel in the second region;

a first signal line electrically connected to the first pixel;

a second signal line electrically connected to the second pixel; and a wiring electrically connected to a first input terminal of the first selector circuit, a first input terminal of the second selector circuit, the first pixel, and the second pixel, wherein a first output terminal of the first shift register is electrically connected to a second input terminal of the first selector circuit, and wherein a first output terminal of the second shift register is electrically connected to a second input terminal of the second selector circuit.

2. The display device according to claim 1, wherein the first pixel comprises a first transistor, a second transistor, a capacitor, and a display element, wherein a gate of the first transistor is electrically connected to the first scan line, and wherein a gate of the second transistor is electrically connected to the wiring.

3. The display device according to claim 2, wherein the first transistor and the second transistor each comprise an oxide semiconductor layer.

4. The display device according to claim 1, wherein each of the first selector circuit and the second selector circuit comprises a third transistor, a fourth transistor, and an inverter, wherein a gate of the third transistor is electrically connected to the wiring and an input terminal of the inverter, and wherein an output terminal of the inverter is electrically connected to a gate of the fourth transistor.

5. The display device according to claim 1, further comprising a transfer signal line driver circuit configured to output a transfer signal to the wiring, wherein, when the transfer signal is supplied to the wiring, potential of all signals output from the scan line driver circuit is low.

6. The display device according to claim 1, wherein the first pixel and the second pixel are located in the same column.

7. A display device comprising:

a scan line driver circuit comprising a first shift register, a second shift register, a first selector circuit, a second selector circuit, a first buffer, and a second buffer;

a pixel portion comprising a first region and a second region;

a first scan line electrically connected to a first pixel in the first region;

a second scan line electrically connected to a second pixel in the second region;

a first signal line electrically connected to the first pixel;

a second signal line electrically connected to the second pixel; and a wiring electrically connected to a first input terminal of the first selector circuit, a first input terminal of the second selector circuit, the first pixel, and the second pixel, wherein a first output terminal of the first shift register is electrically connected to a second input terminal of the first selector circuit, wherein a first output terminal of the second shift register is electrically connected to a second input terminal of the second selector circuit, wherein an input terminal of the first buffer is electrically connected to an output terminal of the first selector circuit, and an output terminal of the first buffer is electrically connected to the first scan line, and wherein an input terminal of the second buffer is electrically connected to an output terminal of the second selector circuit, and an output terminal of the second buffer is electrically connected to the second scan line.

8. The display device according to claim 7, wherein the first pixel comprises a first transistor, a second transistor, a capacitor, and a display element, wherein a gate of the first transistor is electrically connected to the first scan line, and wherein a gate of the second transistor is electrically connected to the wiring.

9. The display device according to claim 8, wherein the first transistor and the second transistor each comprise an oxide semiconductor layer.

10. The display device according to claim 7, wherein each of the first selector circuit and the second selector circuit comprises a third transistor, a fourth transistor, and an inverter, wherein a gate of the third transistor is electrically connected to the wiring and an input terminal of the inverter, and wherein an output terminal of the inverter is electrically connected to a gate of the fourth transistor.

11. The display device according to claim 7, further comprising a transfer signal line driver circuit configured to output a transfer signal to the wiring, wherein, when the transfer signal is supplied to the wiring, potential of all signals output from the scan line driver circuit is low.

12. The display device according to claim 7, further comprising a transfer signal line driver circuit configured to output a transfer signal to the wiring, wherein each of the first buffer and the second buffer is an OR circuit, and wherein, when the transfer signal is supplied to the wiring, each of output signals of the first buffer and the second buffer is low.

13. The display device according to claim 12, wherein the OR circuit has a three input terminal.

14. The display device according to claim 7, wherein the first pixel and the second pixel are located in the same column.

15. A display device comprising:

a scan line driver circuit comprising a first shift register, a second shift register, a first selector circuit, and a second selector circuit;

a pixel portion comprising a first region and a second region;

a first scan line electrically connected to a first pixel in the first region;

a second scan line electrically connected to a second pixel in the second region;

a first signal line electrically connected to the first pixel;

a second signal line electrically connected to the second pixel; and a wiring electrically connected to a first input terminal of the first selector circuit, a first input terminal of the second selector circuit, the first pixel, and the second pixel, wherein a first output terminal of the first shift register is electrically connected to a second input terminal of the first selector circuit, wherein a first output terminal of the second shift register is electrically connected to a second input terminal of the second selector circuit, wherein the first pixel comprises a first transistor, a second transistor, a capacitor, and a display element, wherein each of the first selector circuit and the second selector circuit comprises a third transistor, a fourth transistor, and an inverter, wherein a gate of the third transistor is electrically connected to the wiring and an input terminal of the inverter, wherein an output terminal of the inverter is electrically connected to a gate of the fourth transistor, wherein a gate of the first transistor is electrically connected to the first scan line, one of a source and a drain of the first transistor is electrically connected to the first signal line, and the other of the source and the drain of the first transistor is electrically connected to one of a source and a drain of the second transistor and the capacitor, wherein a gate of the second transistor is electrically connected to the wiring, and the other of the source and the drain of the second transistor is electrically connected to the display element, wherein, when the first transistor is turned ON, the second transistor and the third transistor are turned OFF and the fourth transistor is turned ON, and wherein, when the second transistor is turned ON, the first transistor and the fourth transistor are turned OFF and the third transistor is turned ON.

16. The display device according to claim 15, wherein the first transistor and the second transistor each comprise an oxide semiconductor layer.

17. The display device according to claim 15, further comprising a transfer signal line driver circuit configured to output a transfer signal to the wiring, wherein, when the transfer signal is supplied to the wiring, potential of all signals output from the scan line driver circuit is low.

18. The display device according to claim 15, wherein the first pixel and the second pixel are located in the same column.

19. A method for driving a display device including a matrix of pixels each including a first transistor controlling input of an image signal, a capacitor holding the image signal, and a second transistor transferring the image signal held at the capacitor to a display element, the method comprising the steps of:

in a first sampling period, shifting a selection signal sequentially from first to n-th scan lines (n is a natural number of 2 or more) so that a first image signal is input to a first pixel, and shifting a selection signal sequentially from (n+1)th to 2n-th scan lines so that a second image signal is input to a second pixel;

in a transfer period subsequent to the first sampling period, by inputting a transfer signal to the first pixel and the second pixel, applying a voltage based on the first image signal to a first display element included in the first pixel and applying a voltage based on the second image signal to a second display element included in the second pixel; and in a second sampling period subsequent to the transfer period, shifting a selection signal sequentially from the first to n-th scan lines so that a third image signal is input to the first pixel, and shifting a selection signal sequentially from the (n+1)th to 2n-th scan lines so that a fourth image signal is input to the second pixel; and controlling transmission of light emitted from a light source for the first image signal in the first pixel, and controlling transmission of light emitted from a light source for the second image signal in the second pixel.

20. The method for driving a display device, according to claim 19, wherein a color of the light emitted from the light source for the first image signal and a color of the light emitted from the light source for the second image signal are different from each other.

* * * * *